US005375383A

United States Patent [19]

Lin et al.

[11] Patent Number: 5,375,383

[45] Date of Patent: Dec. 27, 1994

[54] GARAGE DOOR FRAME

[75] Inventors: Tony Y. Lin, Mason; Mark W. Westerfield, Cincinnati, both of Ohio

[73] Assignee: Clopay Building Products Company, Inc., Cincinnati, Ohio

[21] Appl. No.: 91,168

[22] Filed: Jul. 13, 1993

[51] Int. Cl.[5] ..... E04B 1/16

[52] U.S. Cl. ..... 52/217; 52/204.1; 52/656.2; 52/656.9; 52/721; 49/505

[58] Field of Search ..... 49/505, 197; 52/721, 52/656.2, 656.9, 217, 204.1; 403/403, 375

[56] References Cited

U.S. PATENT DOCUMENTS

| | | | |
|---|---|---|---|
| 1,992,006 | 2/1935 | Greegor | 49/197 |
| 2,727,596 | 12/1955 | Smith | 49/505 X |
| 3,104,699 | 9/1963 | Wolf et al. . | |
| 3,111,203 | 11/1963 | Ridder . | |
| 3,226,144 | 12/1965 | Lomaz | 49/197 |
| 3,324,599 | 6/1967 | Brost | 49/505 |
| 3,491,501 | 1/1970 | Lundgren | 52/656.2 X |
| 3,958,367 | 5/1976 | Fairman | 49/197 |
| 4,193,245 | 3/1980 | Johnson . | |
| 4,640,049 | 2/1987 | Duncan | 49/197 |
| 4,747,248 | 5/1988 | Fahs . | |

FOREIGN PATENT DOCUMENTS

| | | | |
|---|---|---|---|
| 2649021 | 5/1977 | Germany | 52/656.9 |
| 1111238 | 4/1968 | United Kingdom . | |

*Primary Examiner*—Lanna Mai
*Assistant Examiner*—Kevin D. Wilkens
*Attorney, Agent, or Firm*—Wood, Herron & Evans

[57] ABSTRACT

A garage door frame has a pair of vertical frame members attached to each lateral end of a horizontal frame member. The door frame components can be transported to the construction or job site and assembled there to avoid the expense of welding at the manufacturer and to better accommodate job site specification and design changes. Alternatively, the components can be pre-assembled at the factory. Each vertical frame member is joined to the horizontal frame member with a unique connector which slidably inserts within the horizontal frame member and between side walls of a U-shaped portion of the vertical frame member. A combination of interlocking ribs and grooves formed in the frame members secures them together. First and second preferred embodiments of the invention are adapted for use with extension spring garage doors and torsion spring garage doors, respectively.

24 Claims, 3 Drawing Sheets

GARAGE DOOR FRAME

FIELD OF THE INVENTION

This invention relates to a frame for an opening, and more particularly, to a garage door frame which can be constructed at a job site or preassembled at the factory.

BACKGROUND OF THE INVENTION

Garage doors used in both commercial and residential applications are commonly mounted to a door frame which is incorporated into a wall of a building or garage. Conventionally, the door frame which is used to position and hang the garage door is formed from a pair of vertical frame members connected to a horizontal frame member. These door flame elements are commonly welded together by the manufacturer and then transported to the construction or building site for incorporation into the building or garage. The garage door itself is hung from the door frame in association with a track or other mechanism for slidably opening and closing the door.

Door flames of this type must be constructed and assembled by the manufacturer and then shipped to the job site. The door frame elements are often fabricated from steel and welded together by the manufacturer and then shipped to the construction or job site.

The disadvantages associated with a door frame of this type include the complicated, expensive and labor-intensive step of welding or securing the frame elements to one another by the manufacturer. In addition, once constructed the door frame requires substantial space for transportation to the job site and is heavy and difficult to handle because of its steel construction. Furthermore, in that each door frame is assembled by the manufacturer, frequently when it arrives at the construction site, modifications to either the door frame or the building into which it is to be incorporated are required due to damage during shipment or building design changes. In that each door frame is assembled by the manufacturer, it is often intended for a specific type of door or application, and later changes in building requirements or specifications result in the door frame being returned to the manufacturer while a different door frame is ordered and delivered to the job site resulting in construction down time and costly delays.

As evidenced by the above background, there is an existing need for a garage door frame that can be easily assembled by the installer at the job site, with a minimum amount of handling, and without the use of complicated fastener mechanisms to maintain the frame elements in an assembled configuration. Furthermore, there is a need for a garage door frame which can be transported to the job site with a minimum amount of space and easily assembled at the job site with a minimal amount of labor, materials, and time. Such a garage door frame must be usable for either pre-hung doors or knock-down doors which are incorporated into the assembled door frame at the job site. The door frame should be adapted for use both in extension spring and torsion spring garage door applications.

SUMMARY OF THE INVENTION

This invention is directed to an improved garage door frame which can be constructed at the job site from door frame elements or preassembled at the factory. The frame elements are preferably fabricated from aluminum which offers lighter weight and better corrosion resistance than the steel frame elements commonly used in the industry. Other materials which also offer these advantages can also be used. The lighter weight aluminum frame elements are fabricated at the manufacture and then transported to the job site. Transportation of the disassembled component frame elements affords less storage and transportation costs compared to the pre-assembled steel door frames previously described, although the frame elements of this invention can also be pre-assembled at the factory. The door frame of this invention is constructed from a pair of vertical side frame members and a horizontal top frame member extending between the vertical frame members. A novel channel connector is used in joining a top end of each vertical frame member to an end of the horizontal frame member. The present invention door frame, including the pair of vertical aluminum frame members, the pair of connectors, and the horizontal frame member, offers ease of assembly which is less costly and less time consuming in comparison to the steel pre-hung garage door frames welded together by the manufacturer. Additionally, job site adjustments, alterations and modifications can be made to the door frame assembly of the present invention to accommodate changes in construction specifications and requirements.

In its broadest aspect, each adjustable frame connector has means for both vertically and horizontally adjusting the top frame and side frame members with respect to each other. In a preferred form the frame is made from extruded tubular aluminum where mating elongated ribs are formed in both the connector and frame members for telescoping sliding engagement to facilitate adjustment. Alternatively, other materials such as steel or plastic, can be used to fabricate these elements from pulltrusion, roll-forming, profile extrusion or other applicable methods.

The present invention encompasses two preferred embodiments. The first of which includes an aluminum box channel horizontal top frame member which has a pair of ribs projecting from an inside surface of a side wall of the box channel along the length of the horizontal frame member. The connector of the present invention is also fabricated from an aluminum box channel and has a generally horizontal groove in an outside surface of one of its side walls. The connector as sized to slidably insert within the horizontal frame members, and the groove in the connector side wall is adapted to mate with the ribs in the horizontal frame member side wall. The connector also has a generally vertical groove in the outside surface of the side wall. When the connector is inserted within the end of the horizontal frame member, a portion of the connector having the vertical groove formed therein extends out from the horizontal frame member to engage the vertical frame member.

A top end portion of each vertical aluminum frame member is configured in a U-shaped channel having a pair of ribs extending vertically on an inside surface of one side wall of the U-shaped channel. The ribs extend the length of the vertical frame member on the inside surface of the side wall and are adapted to slidably engage within the vertical groove in the connector when the connector is slidably interposed between the U-shaped channel side walls of the vertical frame member. A connector is provided in the present invention for each lateral end of the horizontal frame member for attachment to the top end portion of each vertical frame member thereby constructing the garage door frame of the present invention. The first embodiment of the garage door frame is adapted for use with an extension spring garage door such that the vertical frame member forms a right angle with the horizontal frame member, and a top edge of the horizontal frame member is flush with a top edge of each vertical frame member.

A second preferred embodiment of the present invention is designed for use with a torsion spring garage door and is similar to the first embodiment except for the inclusion of a support member. In the second embodiment, the connector engages the horizontal frame member just as in the first embodiment; however, the connector is positioned downwardly from the top edge of the vertical frame member between the side walls of the U-shaped end portion such that a portion of the vertical frame member extends above the connector and the horizontal frame member thereby forming a T-shaped configuration where the horizontal frame member intersects the vertical frame member. The support member is slidably mounted between the channel side walls of the U-shaped portion of the vertical frame member with another portion of the U-shaped channel extending above the horizontal frame member. The support member also has a generally vertical groove formed in an outside surface of a side wall which is adapted to engage the ribs on the inside surface of the vertical frame member side wall. The portion of the vertical frame member containing the support member is adapted for a bracket holding the torsion spring to be secured thereto.

The above features and advantages of the present invention will be better understood in reference to the accompanying figures and detailed description. It should also be understood that particular frame member materials, applications, specific configurations, and geometries of the door frame of this invention are exemplary only, and they are not to be regarded as limitations on the invention.

BRIEF DESCRIPTION OF THE DRAWINGS

Reference is now made to the accompanying figures from which the novel features and advantages of the present invention will be apparent.

DETAILED DESCRIPTION OF THE INVENTION

By way of illustrating and providing a more complete appreciation of the present invention and many of the attendant advantages thereof, the following detailed description is given concerning the novel embodiments of the door frame of the present invention.

Figure 1:
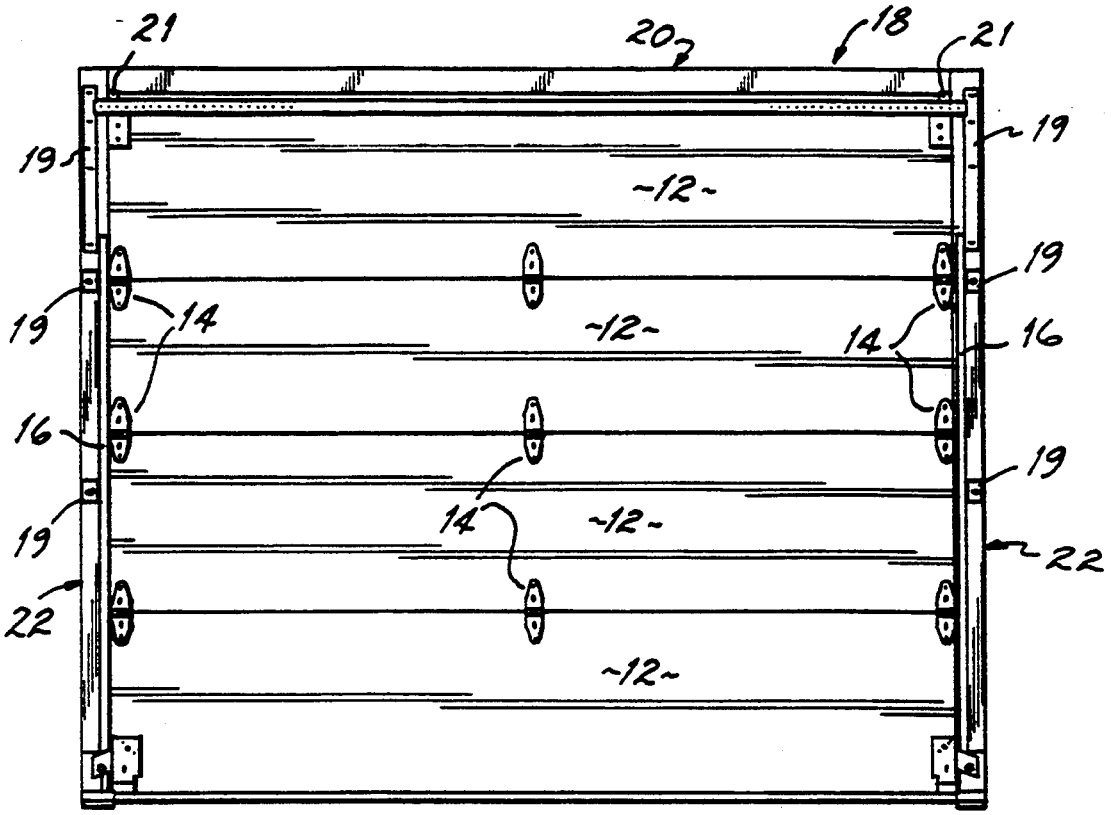
FIG. 1 is a plan view of a garage door and frame incorporating a first embodiment of the present invention.

A first preferred embodiment of the present invention is shown in FIG. 1 as a garage door 10 consisting of a number of serially aligned garage door panels 12. Each garage door panel 12 is connected to the adjacent door panels 12 as by hinges 14. The garage door panels 12 are slidably mounted within a track 16 for conversion between a closed garage door configuration as shown in FIG. 1 and an open garage door configuration (not shown).

Figure 2:
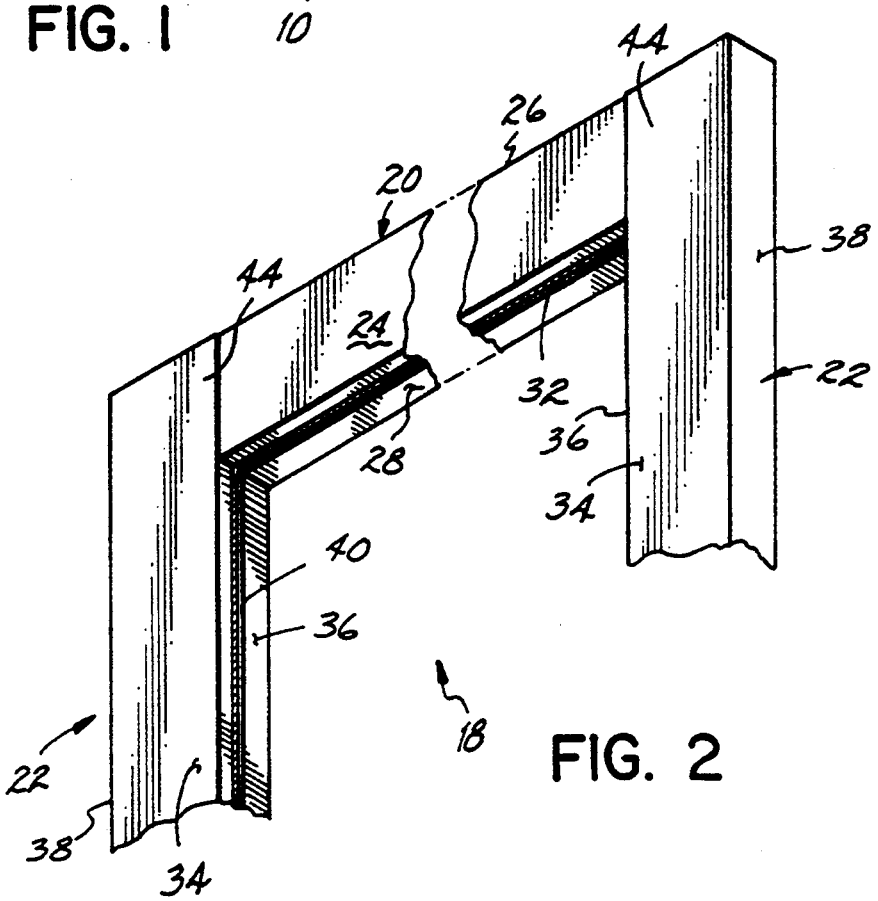
FIG. 2 is a perspective view of the first embodiment of the door frame of FIG. 1.

The garage door panels 12 and track 16 are mounted to a garage door frame 18 by a number of brackets 19, 21. The door frame 18 includes a horizontal top frame member 20 and a pair of vertical side frame members 22. As shown in FIG. 2, a top end of each vertical frame member 22 is secured to each lateral end of the horizontal frame member 20 to form a generally L-shaped intersection.

Figure 3:
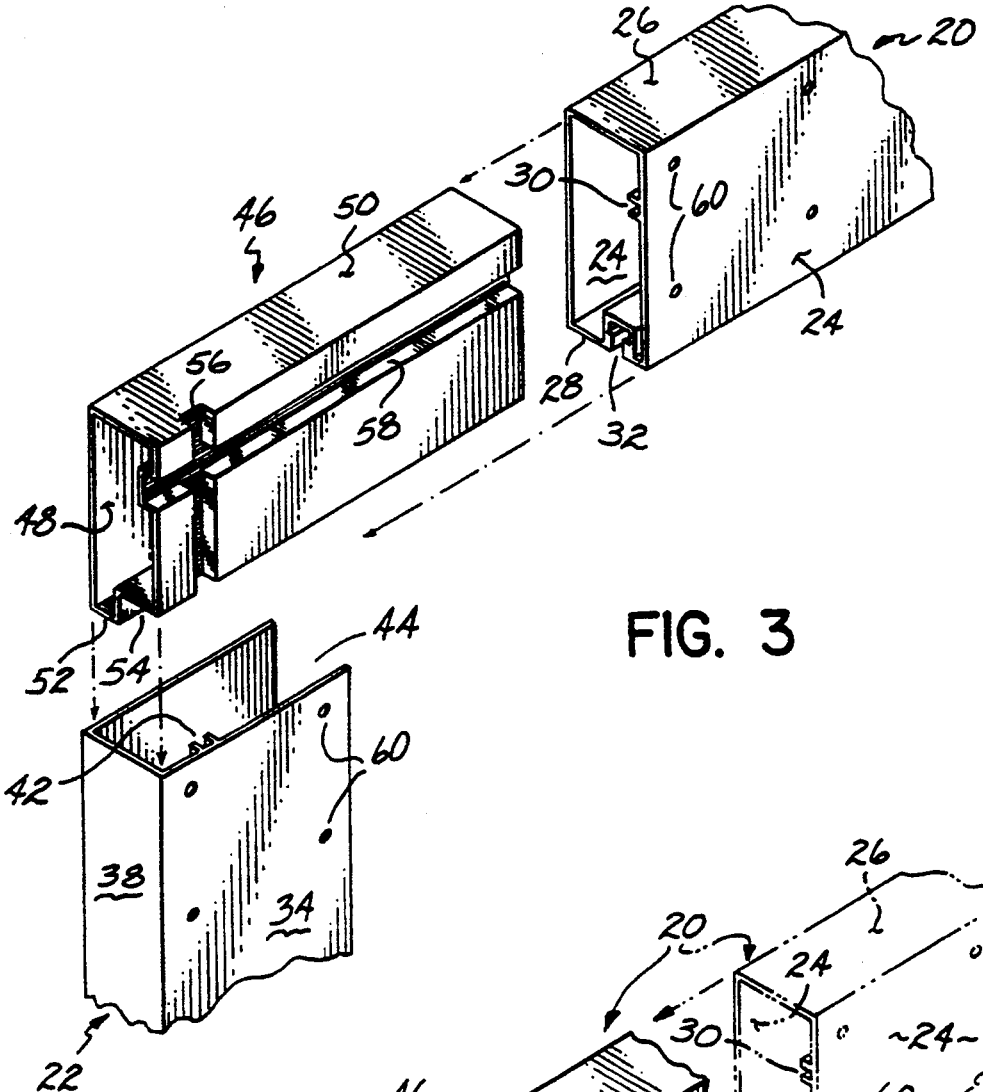
FIG. 3 is an exploded perspective view of the frame members of the first embodiment of the present invention.

Referring to FIG. 3, the horizontal frame member 20 consists of a box channel having a pair of spaced, parallel side walls 24 joined together by a top wall 26 spaced from and parallel to a bottom wall 28. Formed on an inside surface of one side wall 24 and extending the length of the horizontal frame member 20 are a pair of horizontal ribs 30 projecting toward the interior of the horizontal frame member 20. Formed in the horizontal frame member bottom wall 28 and extending the entire length thereof is a T-shaped weatherseal retaining slot 32.

Each vertical frame member 22 is also a box channel configuration having a pair of spaced generally parallel side walls 34 joined together by an inner end wall 36 spaced from and parallel to an outer end wall 38. The inner end wall 36 of each vertical frame member 22 also has a T-shaped weatherseal retaining slot 40 formed therein. When the horizontal frame member 20 is joined to each vertical frame member 22, the weatherseal retaining slots 32, 40 are adapted to conveniently receive a weatherseal strip (not shown) around the interior of the door frame 18 (FIG. 2).

Formed on an inside surface of one of the side walls 34 of the vertical frame member 22 extending the length thereof are a pair of ribs 42 extending vertically and projecting toward the interior of the vertical frame member 22. As can be seen in FIG. 3, the inner end wall 36 of each vertical frame member 22 does not extend to the top edge of the vertical frame member 22 thereby leaving a U-shaped channel upper portion 44 of each vertical frame member 22.

A connector 46 is configured to slide between side walls 34 of the U-shaped portion 44 of each vertical frame member 22. Additionally, the connector 46 is designed to slidably insert within the box channel horizontal frame member 20. The connector 46 consists of a pair of parallel spaced side walls 48 joined together by a top wall 50 spaced from and parallel to a bottom wall 52. A gutter 54 is formed in the bottom wall 52 of the connector 46 and is adapted to mate with the T-shaped weatherseal retaining groove 32 formed in the bottom wall 28 of the horizontal frame member 20 when the connector 46 is slidably inserted within the horizontal frame member 20.

Formed in an outside surface of one of the side walls 48 of the connector 46 are vertical groove 56 and horizontal groove 58. The vertical groove 56 is designed to receive therein the ribs 42 formed on the inside surface of the vertical frame member side wall 34 when the connector 46 is slidably interposed between the side walls 34 of the U-shaped portion 44 of the vertical frame member 22. Similarly, the horizontal groove 58 in the connector 46 is designed to receive therein the ribs 30 formed in the side wall 24 of the horizontal frame member 20 when the connector 46 is slidably inserted therein.

Figure 3A:
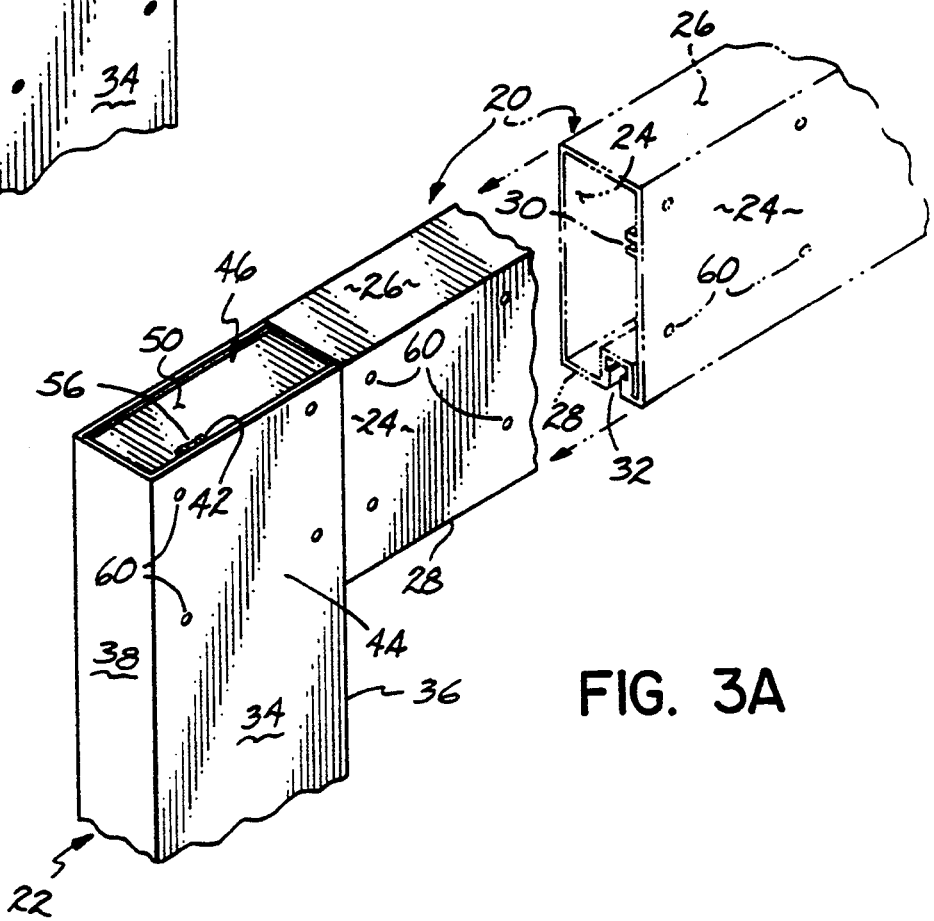
FIG. 3A is an assembled perspective view of the frame members of FIG. 3.

As shown in FIG. 3A, with the connector 46 slidably interposed between the side walls 34 of the U-shaped portion 44 of the vertical frame member 22 and slidably inserted within the box channel of the horizontal frame member 20, the lateral end of the horizontal frame member 20 abuts against the inner edges of the side walls 34 of the U-shaped frame portion 44 of the vertical member 22. The connector 46 is thereby enclosed within the vertical and horizontal frame members 22, 20. In addition, when joined in this manner the top wall 26 of the horizontal frame member 20 is flush with the uppermost edge of the vertical frame member 22.

A number of holes 60 are provided in both the vertical frame member side wall 34 and the horizontal frame member side wall 24 for securing the attachment of the vertical frame member 22 to the connector 46 and the horizontal frame member 20 to the connector 46 as with rivets, screws, or other suitable attachment mechanisms.

The ribs 42 in each vertical frame member 22 provide a stable and secure attachment point for the brackets 19 which attach the track 16 to the door frame. Similarly, the ribs 30 in the horizontal frame member 20 provide a stable and secure attachment point for the brackets 21 along the horizontal frame member 20. In addition, the ribs 30.42 provide a reference line for the proper alignment of the brackets 19, 21 when attaching the track 16 to the door frame 18 in that they extend the length of the horizontal and vertical frame members 20, 22, respectively. The brackets 19, 21 are attached to the frame members as by screws, rivets, or other suitable mechanisms well known in the art.

Figure 4:
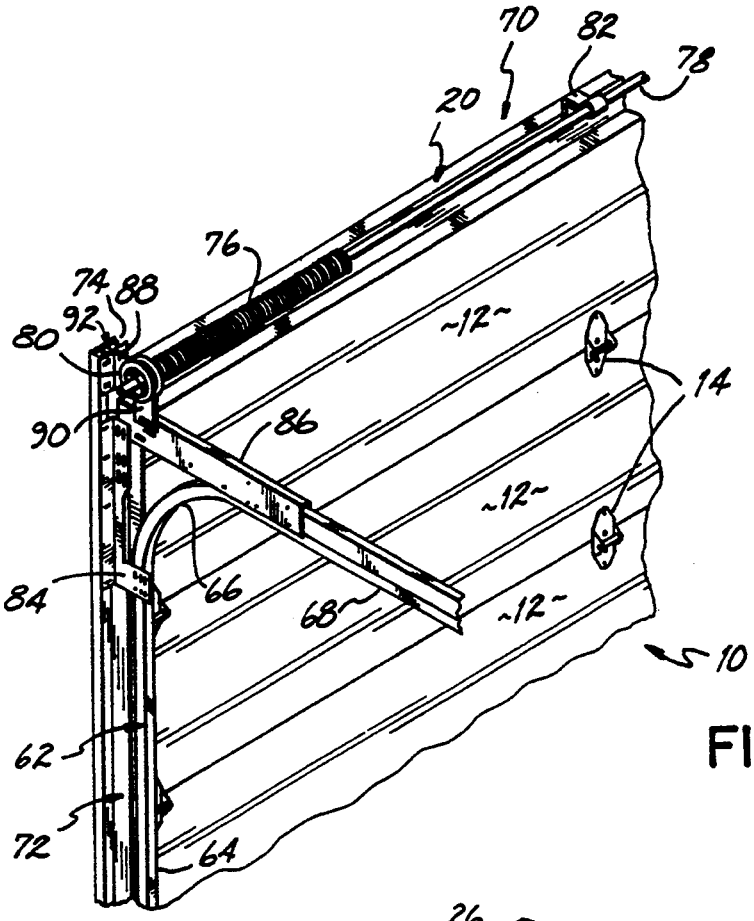
FIG. 4 is a partial perspective view of a garage door and frame incorporating a second embodiment of the present invention.

A second preferred embodiment of the present invention is shown in FIG. 4. A garage door 10 has a number of serially aligned door panels 12 connected to one another with a number of hinges 14 and slidably mounted within a track 62 having a vertical 64, a curved 66, and a horizontal 68 portion. Like elements of the first and second preferred embodiments are identified with like reference numerals herein.

The second preferred embodiment of a door frame 70 according to the present invention is equipped for hanging and positioning the garage door 10 and a track 62. The second preferred embodiment of the door frame 70 includes a horizontal top frame member 20 and a pair of vertical side frame members 72. Each vertical frame member 72 is secured to a lateral end of the horizontal frame member 20 such that an elongated U-shaped channel portion 74 of the vertical frame member 72 extends above the horizontal frame member 20. A torsion spring 76 is concentrically mounted over a torsion tube 78 which extends generally parallel to the horizontal frame member 20. The torsion spring 76 is mounted to a reel 80 secured at each lateral end of the torsion tube 78. The torsion tube 78 is centrally supported by a center support bracket 82 secured to the horizontal frame member 20.

A flag bracket 84 secures the vertical portion 64 of the track 62 to the vertical frame member 72, and a starter angle 86 supports the horizontal portion 68 of the track 62 by attachment also to the vertical frame member 72. A first and second bearing plate 88, 90 are positioned generally orthogonal to one another and support the reel 80 positioned at each end of the torsion tube 78. The first bearing plate 88 is secured to the U-shaped channel portion 74 of the vertical frame member 72 extending upwardly above the horizontal frame member 20; whereas, the second bearing plate is secured to the starter angle 86. The bearing plates 88, 90, flag bracket 84, starter angle 86, and center support bracket 82 are each secured to the door frame 70 as by rivets, screws, or other suitable attachment mechanisms commonly known in the art.

The horizontal frame member 20 and a connector 46 of the second embodiment of the door frame 70 of the present invention are each identical to the corresponding components in the first embodiment of the present invention as previously described.

Figure 5:
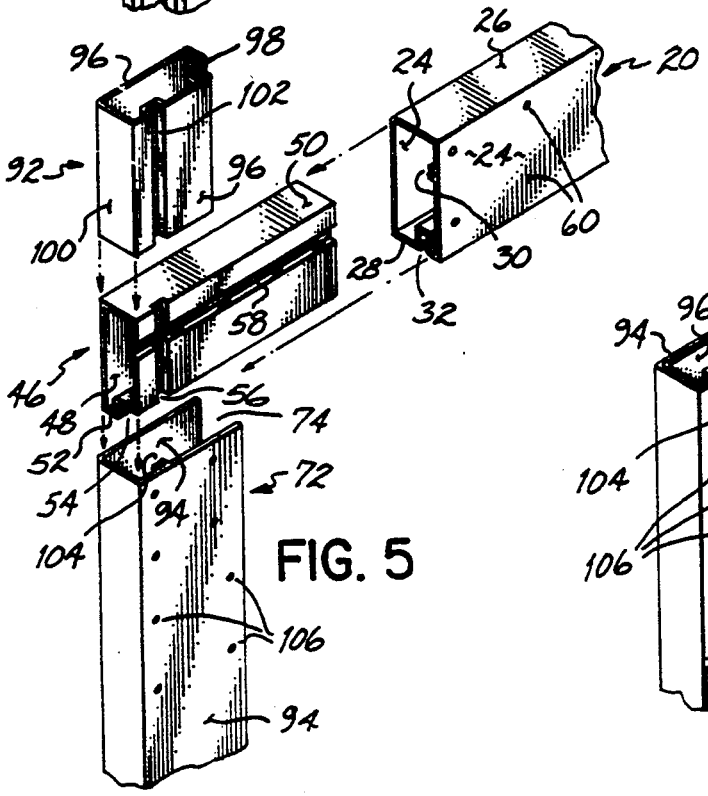
FIG. 5 is an exploded perspective view of the frame members of the second embodiment.
Figure 5A:
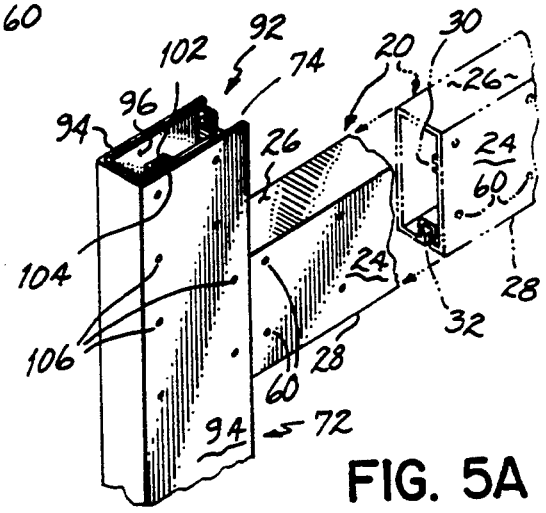
FIG. 5A is an assembled perspective view of the frame members of FIG. 5.

As shown in FIGS. 5 and 5A, the elongated U-shaped channel portion 74 proximate to the upper end of each vertical frame member 72 is longer than the corresponding U-shaped portion 44 of the vertical frame member 22 in the first embodiment, thereby enabling the connector 46, which is slidably inserted within the horizontal frame member 72, to be positioned further down along the vertical frame member 72. As a result, the upwardly extending portion 74 of the vertical frame member 72 projects above the top wall 26 of the horizontal frame member 20 thereby forming a T-shaped configuration at the intersection of the horizontal frame member 20 and the vertical frame member 72.

A support member 92 is provided in the second preferred embodiment of the present invention to slidably interpose between side walls 94 of the vertical frame member 72 in the upwardly extending portion 74 thereof. The support member 92 includes a pair of side walls 96 parallel to and spaced from one another and an inner wall 98 spaced from and parallel to an outer wall 100 for joining the side walls 96 together. Integrally formed in an outer surface of one of the support member side walls 96 is a vertical groove 102 which is adapted to receive therein a pair of vertical ribs 104 projecting from an inside surface of the side wall 94 and extending the length of the vertical frame member 72.

A number of holes 106 are provided in the side wall 94 of the vertical frame member 72, including the upwardly extended portion 74 thereof, and the side wall 24 of the horizontal frame member 20 for rivets, screws, or other appropriate attachment mechanisms for securing the horizontal frame member 20 to the connector 46 and the vertical frame member 72 to both the connector 46 and the support frame member 92. The upwardly extended portion 74 of the vertical frame member 72 provides a secure attachment surface for the first bearing plate 88 supporting the reel 80 on the torsion tube 78. Therefore, the second preferred embodiment of the door frame 70 of the present invention is adapted for assembly at the job site for use with a torsion spring garage door. Alternatively, the door frame 70 could be pre-assembled at the factory and transported to the job site.

The ribs 30, 104 offer a secure attachment point for the brackets 84, 82 and bearing plate 88 while providing a reference point for alignment of the track 62 and the torsion tube 78 of the second embodiment of the present invention.

From the above disclosure of the general principles of the present invention and the preceding detailed description of preferred embodiments, those skilled in the art will readily comprehend the various modifications to which the present invention is susceptible. Therefore, we desire to be limited only by the scope of the following claims and equivalents thereof:

We claim:

1. An adjustable frame for installation of a closure assembly, said frame comprising:

a horizontal top frame member having opposite ends;

two vertical side frame members each having an end for connecting with one of said ends of said top frame member;

a connector for adjustably connecting each said top frame member end with one of said side frame member ends to provide for a plurality of frame configurations, one of said frame configurations having a top edge of said top frame member positioned below top edges of said side frame members; and each said connector having means for both vertically and horizontally adjusting said top frame member with respect to each said side frame member within a plane containing said top and side frame members thereby facilitating the installation of the closure assembly.

2. The adjustable frame of claim 1 wherein each said connector is a telescoping connector for adjustably connecting said top frame member and said side frame members.

3. The adjustable frame of claim 1 wherein each said connector has a pair of elongated grooves for slidably engaging a mating rib on each end of said top and side frame members for said vertical and horizontal adjustment.

4. The adjustable frame of claim 3 wherein said top frame member, said side frame members, and said connector are each extruded aluminum having said respective ribs and grooves formed therein.

5. The adjustable frame of claim 3 wherein said top and side members are tubular with said ribs formed on an inside surface thereof.

6. The adjustable frame of claim 1 further comprising:

means on said top frame member and on said side frame members for retaining a weatherseal strip.

7. The adjustable frame of claim 1 wherein said adjusting means comprises a first rib on said top frame member and a second rib on each said side frame member, and a first and second groove on said connector whereby said first and second ribs are adapted to slidably engage said first and second grooves, respectively, when said top frame member and said side frame members are connected to said connector.

8. The adjustable frame of claim 1 further comprising:

a support for adjustably connecting to each said side frame member end, said support facilitating the attachment of a spring to the frame to assist in selectively opening and closing the closure assembly; and means on said support for vertically adjusting said support with respect to said side frame member.

9. The adjustable frame of claim 8 wherein said support is a telescoping support for adjustably connecting to each side frame member.

10. The adjustable frame of claim 8 wherein said support adjusting means comprises a groove on said support and a rib on said side frame member for slidably engaging therein said support groove when said support is connected to said side frame member.

11. An adjustable frame for installation of a closure assembly, said frame comprising:

a tubular extruded aluminum horizontal top frame member having opposite ends;

two tubular extruded aluminum side frame members each having an end for connecting with one of said ends of said top frame member;

a tubular extruded aluminum connector for vertically and horizontally adjustably connecting each said top frame member end with one of said side frame member ends, said connector having opposite ends; and an elongated groove formed on an outside surface at each said end of said connector for slidably engaging a mating rib formed on an inside surface of each said top and side frame members for said vertical and horizontal adjustment, each said mating rib extending along the respective length of said top and side frame members.

12. An adjustable garage door frame for installation of a garage door comprising:

a horizontal top frame member having opposite ends;

two vertical side frame members each having an end for connecting with one of said ends of said top frame member;

a connector for adjustably connecting each said top frame member end with one of said side frame member ends to provide for a plurality of frame configurations, one of said frame configurations having a top edge of said top frame member positioned below top edges of said side frame members; and each said connector having means for both vertically and horizontally adjusting said top frame member with respect to each said side frame member within a plane containing said top and side frame members thereby facilitating the installation of the garage door.

13. The adjustable garage door frame of claim 12 wherein each said connector is a telescoping connector for adjustably connecting said top frame member and said side frame members.

14. The adjustable garage door frame of claim 12 wherein each said connector has a pair of elongated grooves for slidably engaging a mating rib on each end of said top and side frame members for said vertical and horizontal adjustment.

15. The adjustable garage door frame of claim 14 wherein said top frame member, said side frame members, and said connector are each extruded aluminum having said respective ribs and grooves formed therein.

16. The adjustable garage door frame of claim 14 wherein said top and side members are tubular with said ribs formed on an inside surface thereof.

17. The adjustable garage door frame of claim 14 further comprising:

track means for mounting the garage door to facilitate the selective opening and closing of the garage door; and bracket means for securing said track means to said top frame member and said side frame members whereby said ribs on said top and side frame members provide for alignment and stability in securing said bracket means to said top and side frame members.

18. The adjustable garage door frame of claim 12 wherein said adjusting means comprises a first rib on said top frame member and a second rib on each said side frame member, and a first and second groove on said connector whereby said first and second ribs are adapted to slidably engage said first and second grooves, respectively, when said top frame member and said side frame members are connected to said connector.

19. The adjustable garage door frame of claim 12 further comprising:

means on said top frame member and on said side frame members for retaining a weatherseal strip.

20. The adjustable garage door frame of claim 12 further comprising:

a support for adjustably connecting to each said side frame member end, said support facilitating the attachment of a spring to the frame to assist in selectively opening and closing the garage door; and means on said support for vertically adjusting said support with respect to said side frame member.

21. The adjustable garage door frame of claim 20 wherein said support is a telescoping support for adjustably connecting to each said side frame member.

22. The adjustable garage door frame of claim 20 wherein said support adjusting means comprises a groove on said support and a rib on said side frame member for slidably engaging therein said support groove when said support is connected to said side frame member.

23. An adjustable garage door frame for installation of a garage door comprising:

a tubular extruded aluminum horizontal top frame member having opposite ends;

two tubular extruded aluminum side frame members each having an end for connecting with one of said ends of said top frame member;

a tubular extruded aluminum connector for vertically and horizontally adjustably connecting each said top frame member end with one of said side frame member ends, said connector having opposite ends; and an elongated groove formed on an outside surface at each said end of said connector for slidably engaging a mating rib formed on an inside surface of each said top and side frame members for said vertical and horizontal adjustment, each said mating rib extending along the respective length of said top and side frame members.

24. An adjustable frame for installation of a closure assembly, said frame comprising:

a horizontal top frame member having opposite ends;

two vertical side frame members each having an end for connecting with one of said ends of said top frame member;

a connector for adjustably connecting each said top frame member end with one of said side frame member ends; and each said connector being inserted into at least one of said top and side frame members and having means for both vertically and horizontally adjusting said top frame member with respect to each said side frame member within a plane containing said top and side frame members thereby facilitating the installation of the closure assembly.

* * * * *